United States Patent [19]

Platt

[11] Patent Number: 4,798,323

[45] Date of Patent: Jan. 17, 1989

[54] WEDGE SHAPE CARTON AND BLANK

[75] Inventor: Ronald Platt, Chicago, Ill.

[73] Assignee: Crane Carton Company, Chicago, Ill.

[21] Appl. No.: 118,443

[22] Filed: Nov. 9, 1987

[51] Int. Cl.[4] ..... B65D 5/02

[52] U.S. Cl. ..... 229/115; 229/41 R; 229/149

[58] Field of Search ..... 229/41 R, 41 B, 115, 229/141, 149, 122, 126, 114, 40

[56] References Cited

U.S. PATENT DOCUMENTS

| | | | |
|---|---|---|---|
| 1,673,176 | 6/1928 | Benner | 229/115 |
| 1,814,561 | 7/1931 | Krumm | 229/115 |
| 1,822,512 | 9/1931 | Tanner | 229/149 |
| 2,107,946 | 2/1938 | Inman | 229/115 |
| 2,220,110 | 11/1940 | Layton | 229/115 |
| 2,309,134 | 1/1943 | Morgan | 229/114 |
| 3,357,544 | 12/1967 | Gingher | 229/40 |
| 3,369,727 | 2/1968 | Wright | 229/115 |
| 3,785,478 | 1/1974 | Drori | 229/126 |
| 3,827,624 | 8/1974 | Dogliotti | 229/149 |
| 4,313,542 | 2/1982 | Roberts et al. | 206/611 |

FOREIGN PATENT DOCUMENTS

| | | | |
|---|---|---|---|
| 0463 | 1/1899 | United Kingdom | 229/149 |
| 17679 | 6/1904 | United Kingdom | 229/115 |

*Primary Examiner*—Stephen Marcus

*Assistant Examiner*—Gary E. Elkins

*Attorney, Agent, or Firm*—James N. Videbeck

[57] ABSTRACT

A wedge shape folding carton is adapted for packaging individual slices of food product, preferably pizza slices. The blank for the wedge shape carton is generally trapezoidal in shape composed of three generally equilateral triangles positioned in juxtaposed serial spaced relation with the spacing between adjacent triangles filled by a pair of elongate rectangular size panels. A third elongate generally rectangular side panel extends from the base or free remaining side of the middle triangle. One of the end triangles has a cut-out portion formed on its base, and also has a generally rectangular fourth side panel extending from its remaining side. The middle triangle in the trapezoidal blank forms the bottom of the carton, the three rectangular side panels surrounding the bottom panel are folded perpendicular to the bottom panel to form the sides of the wedge shape carton, and the top of the carton is formed by bending the end triangle having the cut-out portion over the bottom triangle such that its fourth side panel is positioned in lapped relation with the side panel extending from the free side of the bottom triangular panel. The third triangular panel forms a cover for the cut out portion of the top triangle and is foldable over the top triangle and simply secured thereover by a tab and groove cut-outs in the top and cover triangles, respectively.

7 Claims, 2 Drawing Sheets

10
17
18
14
25
24
31
16a
11b
16
20
15b
15
15a
30
17a
21
28
11a
11c
27
23
13
12a
12
26a
26b
26c
22
11

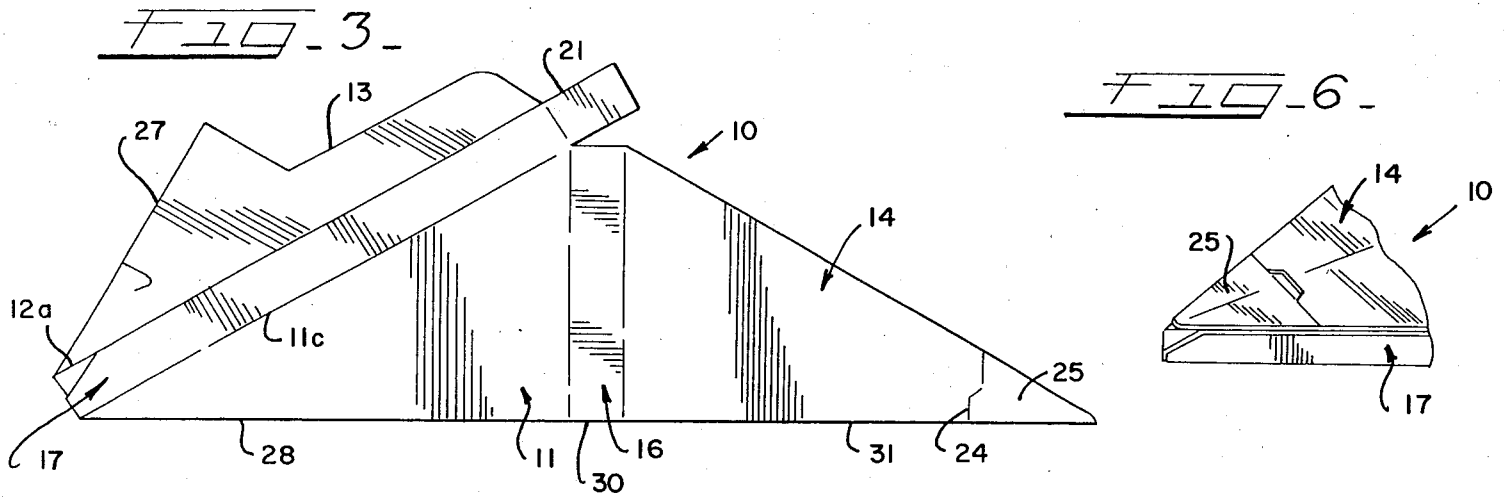
FIG. 3
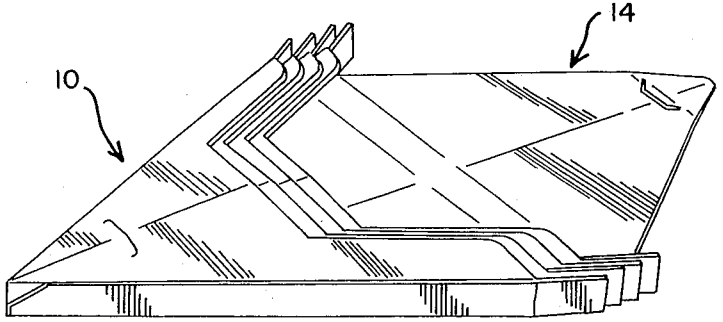
FIG. 4
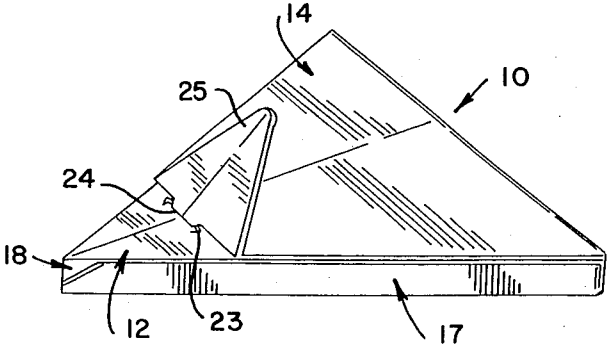
FIG. 5
FIG. 6

WEDGE SHAPE CARTON AND BLANK

BACKGROUND OF THE INVENTION

This invention relates to improvements in wedge-shape folding cartons preferably used for containing wedge shape food products, and, more particularly, to an improved wedge shape folding carton which, when in an open condition is stackably nestable with other like shape cartons, and which also may be folded flat from an open condition, for efficient storage and shipping of same.

Heretofore known individual containers for single slices of pie, pizza and other wedge-shape food products have consisted of generally diamond-shaped blanks defining triangular top and bottom panels positioned on opposing sides of a rectangular back side panel. Generally, the converging sides of the top and bottom panels have included additional rectangular side panels extending therefrom which may be overlapped in juxtaposed relation when the top panel is positioned in closing relation with the bottom panel. Such overlapping side panels have been joined by adhesive or heat sealing to close the container. Additionally, small rectangular outlined folding cartons have been used for containing individual pizza slices. These cartons have had top, bottom and four side surfaces of generally rectangular shape, and the top of such cartons have been closable over their bottom and side surfaces and retained in closed position by a tab-in-slot frictional relation. A single-serving pie carton is disclosed in U.S. Pat. No. 4,313,542.

A need has developed for an improved wedge-shape folding carton for containing single serving food products of similar wedge shape. It is an object of the present invention generally stated, to provide a new and improved wedge shape folding carton for containing wedge-shape food products which is of improved and more efficient construction, and which may be selectively re-openable.

SUMMARY OF THE INVENTION

The invention is directed in a wedge shape folding carton adapted for forming a completed structure. The carton includes parallel spaced generally triangular top and bottom panels connected by a pair of converging generally rectangular side panels extending in joined-edge relation therebetween to define a hollow wedge shape interior of the carton and an operable end thereto. A third generally rectangular side panel extends from the bottom panel at the openable end. A generally triangular cover panel extends from the third generally rectangular side panel in mirrored position therefrom with the triangular bottom panel. The third side panel is hingedly connected to the bottom panel and hingedly connected to the cover panel to close the openable end of the carton with the cover panel overlying the top panel when the carton is in closed position. The third side panel lies in coplanar relation with the bottom panel and the cover panel when the carton is in open position. The carton defines a nestable-stackable relation between multiple like open ones of the wedge shape folding carton when the same are positioned together.

BRIEF DESCRIPTION OF THE DRAWINGS

The features of the present invention, which are believed to be novel, are set forth with particularity in the appended claims. The invention may best be understood by reference to the following description of a currently preferred embodiment in connection with the accompanying drawings, wherein like reference numerals identify like elements throughout and in which:

FIG. 3 is a top plan view of the carton shown in FIG. 2 when the carton is folded flat along its central axis;

FIG. 4 is a perspective view of a plurality of wedge shape cartons of the present invention as they appear in ready-to-use, nested-stacked relation;

FIG. 5 is a perspective view of the preferred embodiment of the present invention as it appears in closed position with the cover retaining tab in initial engagement with its retaining slot on the carton top panel; and FIG. 6 is a fragmentary perspective view similar to the front portion of FIG. 5 wherein the cover retaining is shown in completely closed position.

DETAILED DESCRIPTION OF THE PREFERRED EMBODIMENT

Figures 1, 2:
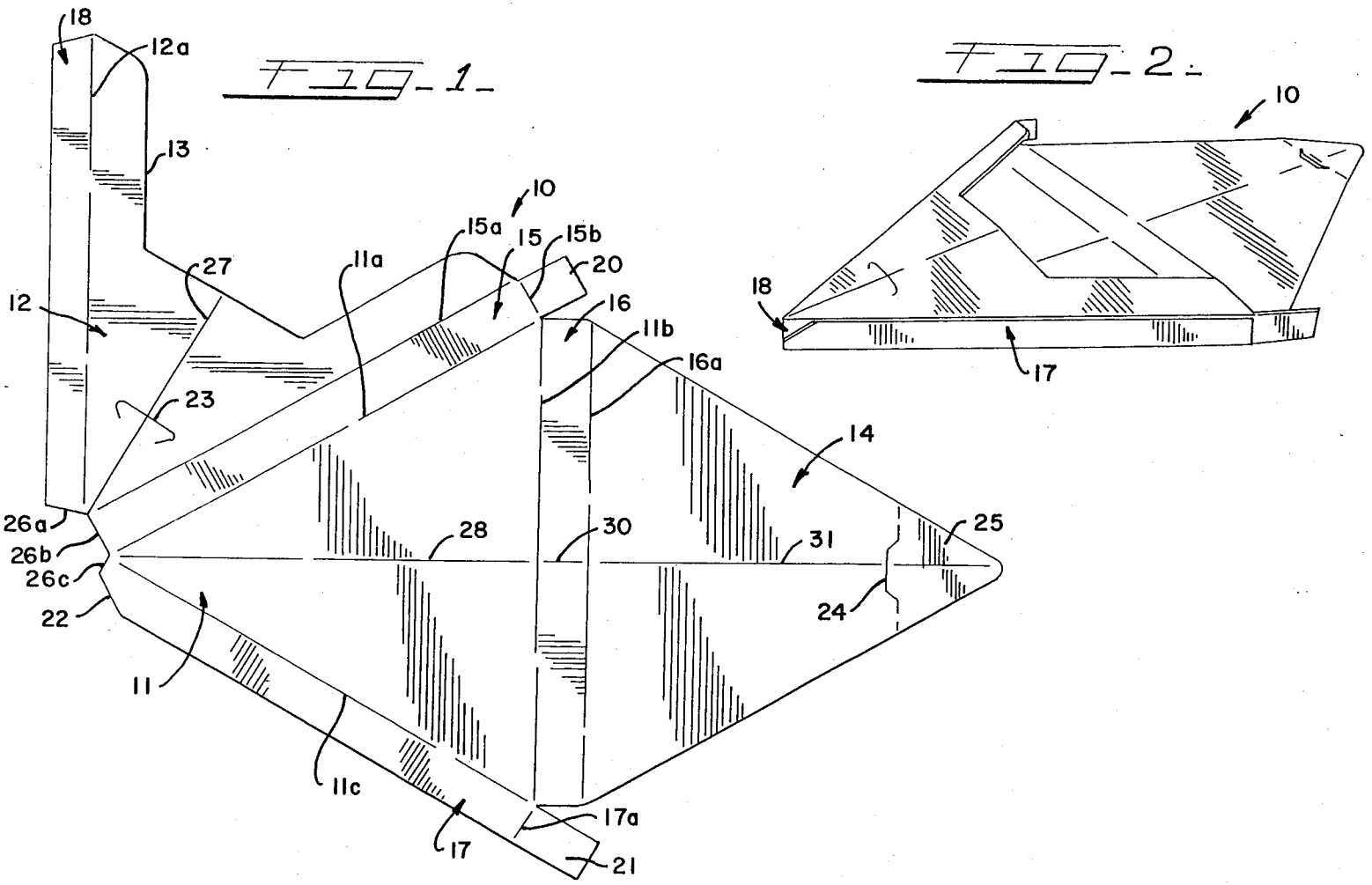
FIG. 1 is a top plan view of a carton blank for a preferred embodiment of the instant invention from which the carton is formed.
FIG. 2 is a perspective view of the carton of the present invention shown in open, ready-to-use position.

Referring to FIGS. 1 and 2, the wedge shape folding carton of the present invention, generally indicated at 10, is shown as a single piece, flat blank in FIG. 1, and as it appears in open, ready-to-use position in FIG. 2. The folding carton 10 as it appears in blank in FIG. 1 is generally trapezoidal in shape and is made up of three generally triangular portions, and four generally elongate rectangular portions. The triangular portions include a central base triangle panel 11, a generally triangular top panel 12 which includes a trapezoidal cut out portion adjacent its base defined by line 13, and a generally triangular cover 14. Three elongate generally rectangular side panels surround the central base triangle 11 side panel 15 joins top cover 12 and base panel 11, side panel 16 joins the bases of bottom panel 11 and cover panel 14, and side panel 17 extends from the shorter of the two parallel sides of trapezoid blank 10. An additional side panel 18 as shown most clearly in FIG. 2, is intended to underlay panel 17 and is adhesively affixed thereto in the completed carton structure. In addition, side panels 15 and 17 have foldable tabs 20, 21, respectively, extending from their base ends and panel 17 has a diagonal cut line 22 extending from its nose end 26C. Finally, top triangular panel has a generally C-shape cut out 23 positioned inwardly adjacent to the nose thereof, and cover panel 14 is a cut out tab 24 defining the inward end of a bendable nose section 25 thereof.

The boundaries between the triangular base portion 11 and side panels 15, 16 and 17 are formed at crease line **11*a*, 11*b*, and 11*c*, respectively. The division between the base side panel 16 and the cover panel 14 is at crease line 16*a*; the division between side panel 15 and top triangular portion 12 is at crease line 15*a*, the division between top cover portion 12 and side panel 18 is at crease line 12*a*; the division between side panels 15 and tab 20 is at crease line 15*b*; and the division between side panel 17 and tab 21 is at crease line 17*a***.

In the preferred embodiment, blank 10 is made of cardboard or paperboard material which may contain an outer layer of moisture proof material thereover to maintain the integrity of both the carton, and any food product positioned therein. The present wedge shape container 10 is not shown in a hermetically sealed condition. However, it should be noted that in addition to the adhesive connection between side panels 17 and 18 shown in FIG. 2, adhesive connections may be made between tabs 20, 21 and base side panel 16, between the top surface of top panel 12 and the bottom surface of cover panel 14, and between the panel edges 26*a*, 26*b* and 26*c* defining the nose in order to provide a hermetically sealed container, if desired. The preferred use of the present embodiment of the container of the invention is for containing pre-baked individual serving slices of pizza when purchased in carry-out fashion. The container is adapted to hold, contain and protect an individual wedge shaped slice of pizza on its trip from a restaurant or carry out pizza parlor to the consumer's place of desired consumption of the contents.

When discussing the assembly of the carton 10 of the present invention for storage and shipping, two crease lines, one defining an altitude of the top portion 12, and the other defining the altitudes of the base 11 and top cover 12, become important. The first crease i positioned to bisect the nose angle of triangular top portion 12 and is designated as 27, and the second crease is positioned to bisect the nose angles of triangular base 11, top cover 14, and the base side surface 16, and is designated 28 along base triangle 11, 30 along base side panel 16, and 31 along triangular cover panel 14. In the preferred embodiment of the present invention, the grain of the folding carton paperboard material runs parallel with crease line 28, 30, 31.

Assembly of the folding carton is very easy. The blank 10 is creased along lines 11*a* and 15*a* until the triangular top panel 12 is substantially parallel and spaced from triangular bottom panel 11. Creases 12*a* and 11*c* form the upper and lower corners of a double side wall formed by overlaying side panel 17 over side panel 18, and adhesively joining same. When assembled as noted, the folding carton blank 10 will appear as the open carton 10 in FIG. 2.

In one aspect of the present invention, a wedge shape carton of the present invention 10 may be folded flat in a substantially two layered configuration, as shown most clearly in FIG. 3, for efficient shipping and/or storage. In order to form the carton 10 as shown in FIG. 3, the blank shown in FIG. 1 is folded with the bottom triangle 11, base side panel 16 and cover triangular panel 14 folded along crease line 28, 30 and 31 respectively. Additionally, the top triangular portion 12 is folded along crease line 27 so that when making the two differing folds along the differing crease lines, side panel 18 underlies side panel 17 and is adhesively affixed thereto. A plurality of flat folded carton blanks 10, such as shown in FIG. 3, may be shipped or stored in their substantially half size flat condition.

From the stored or shipping condition shown most clearly in FIG. 3, the wedge shape carton of the present invention may be opened and positioned in ready-to-use condition as shown most clearly in FIG. 2, by flattening the creases 27 and 28, 30 and 31 while folding the crease lines 11*c*, 12*a*, 11*a*, and 15*a*, respectively.

In another aspect of the present invention, the operation of unfolding the folded carton blank shown in FIG. 3 to the open wedge shape container of FIG. 2 is most preferably to be performed by workers during substantially idle periods of the work day. However, it should be noted that the unfolding operation is easily and quickly performed and may also be performed one at a time as each wedge-shape carton is utilized for containing food product therein. However, it is anticipated in preparation for lunch time, dinner time, or snack time use, that workers will unfold a plurality of wedge shape carton blanks at one time. In one aspect of the present invention, the wedge shape carton 10 of the present invention when in open condition as shown in FIG. 2 may be nested or stacked within one another, as shown most clearly in FIG. 4, in an area where they may be speedily retrieved for use during peak working periods.

In the nested, stacked relation shown in FIG. 4, a plurality of the wedge shape cartons 10 of the present invention may be efficiently stacked in ready-to-use condition. Food product, most preferably individual pizza slices (not shown) may be positioned in the container 10 while it is in stacked, nested relation as shown in FIG. 4, or the individual container 10 may be removed from either end of the stack, and the food product or pizza slice inserted into the interior of the carton thereafter.

In another aspect of the present invention, as shown most clearly in FIGS. 5 and 6, the wedge-shape container 10 of the present invention may be closed by folding inwardly tabs 20 and 21 at creases 15*e* and 17*a* respectively, and folding the creases 11*b* and 16*a* of base side panel 16 such that cover panel 14 overlays the triangular top panel 12. As the cover panel 14 is positioned over the triangular top panel 12, tabular portion 25 may be bent backwardly to expose tab 24 as shown most clearly in FIG. 5. Tab 24 is then inserted into C-shape slot 23, and is retained therein when the nose 25 is flattened forwardly, as shown most clearly in FIG. 6. As a result of this construction, wedge-shape carton 10 of the present invention is equipped with a lockable, selectably reopenable cover 14 which will both lock the cover in place and facilitate its reopening to allow the food product therein to be removed and eaten. Also, if the food product is only partially eaten, it may be placed back in the container 10 which may be reclosed as it was originally closed, for additional storage in a refrigerator, or the like.

Thus, a wedge-shape container 10 has been shown and described which provides for ease of shipping and storing in an efficient manner, and ease of assembly or unfolding to an open position where it may be stacked with other such like cartons in nested relation prior to use. The carton 10 may be readily easily used by positioning a food product therein, such as individual pizza slice, enclosing the cover 14 over top triangular panel 12, and locking the cover thereover with the nose tab 24 retained in slot 23. Also, it should be noted that when the nose tab 25 is in its locked downward position, a plurality of wedge shape cartons 10 of the present invention may be vertically stacked on top of one another.

While one embodiment of the invention has been shown and described, it will be obvious to those skilled in the art that changes and modifications may be made without departing from the invention in its broader aspects. Therefore, the aim of the appended claim is to cover all such changes and modifications as fall within the true spirit and scope of the present invention.

What is claimed is:

1. A blank for forming a wedge shape carton having a hinged cover, said blank comprising:

a triangular bottom panel having a base side and two converging sides extending from opposing ends of said base side, a rectangular first side wall including opposed elongate base side and opposed short end sides connecting adjacent ends of said opposed elongate base sides, one of said opposed elongate base sides being hingedly connected to one of said two converging sides, a generally triangular top panel having a base side and two converging sides, one of said top panel converging sides being hingedly connected to the other of said opposed elongate base sides on said rectangular first side wall along at least a greater portion of its length, a rectangular second sidewall including opposed elongate base sides and opposed short end sides connecting adjacent ends of said opposed second sidewall elongate base sides, one of said second sidewall opposed elongate base sides being hingedly connected to said base side of said triangular bottom panel, a generally triangular cover panel having a base side and two converging sides extending from opposing ends of said cover panel base side, said base side of said cover being hingedly connected to the other of said opposed elongate base sides on said rectangular second side wall, a rectangular third sidewall including opposed elongate base sides and opposed short end sides extending from the other of said two converging sides on one of said triangular bottom panel and said generally triangular top panel, and a generally rectangular fourth sidewall including opposed elongate base sides and opposed short end sides extending from the other of said two converging sides on the other of said triangular bottom panel and said generally triangular top panel for being positioned in juxtaposed lapped relation with said third rectangular sidewall and being fixed thereto.

2. The blank as defined in claim 1 further including fastener means on said cover panel adjacent a point formed by said two converging sides thereof, and complementary fastener means on said top panel adjacent a point formed by said two converging sides thereof for selectably releasably fixing said cover panel including said point thereof in overlying relation with said top panel.

3. The blank as defined in claim 1 wherein said cover panel includes a male tab positioned adjacent a nose thereof and said top panel includes a complementary female slot positioned adjacent a nose thereof for selectably releasable engagement therebetween when said blank is formed into a carton.

4. The blank as defined in claim 1 wherein said triangular top, bottom and cover panels are the three largest panels in area on said blank, and each include two sides of like length defining isosceles triangles and having altitudes defining co-planar articulate hinges when said blank is formed into a carton in open position, allowing said open carton to be folded flat in half along said altitudes in a storable position.

5. The blank as defined in claim 1 wherein said top panel base side includes a trapezoidal cut-out portion extending inwardly on said panel for defining a portion of an opening on said wedge shape carton when formed.

6. In a wedge shape folding carton including a triangular base panel having three sides, first, second and third substantially rectangular side panels with one extending from each side of said triangular side panels with one extending from each side of said triangular base panel, a top panel bridging between and connected to said first and second rectangular side panels in spaced relation to said triangular bottom panel, and a triangular cover panel extending form said third rectangular side panel and adapted to be folded over said top panel when said carton is in closed position, said top panel, said bottom panel, said cover panel and said third rectangular panel each including a foldable crease lying in a plane which bisects said carton, said carton being foldable in half along said creases when said carton is in an open position to define a substantially flat substantially dual-layer structure suitable for efficient storage or shipping.

7. In a wedge shape folding carton adapted for forming a completed structure having parallel, spaced like-oriented generally triangular top and bottom panels connected by a pair of converging generally rectangular side panels extending in joined edge relation therebetween to form a convex wedge shape exterior and a hollow wedge shape interior of said carton defining an opening end, a third generally rectangular side panel extending from said bottom panel at said openable end, and a generally triangular cover panel extending from said third generally rectangular side panel in mirrored position therefrom to said triangular bottom panel, the invention comprising said third side panel being hingedly connected to said bottom panel and hingedly connected to said cover panel to close said openable end of said carton with said cover panel overlying said triangular top panel when said carton is in closed position, and to lie in co-planar relation with said bottom panel and said cover panel when said carton is in an open position, and defining a nestable relation between multiple like ones of said wedge shape folding carton when stacked together, with a convex wedge shaped exterior of any multiple like ones of said carton substantially fitting inside said hollow edge shape interior of said carton.

* * * * *